US007559878B2

(12) United States Patent
Hakooz

(10) Patent No.: US 7,559,878 B2
(45) **Date of Patent: *Jul. 14, 2009**

(54) COMPACT MULTIMODE DEVICE AND METHOD FOR LOW IMPACT THERAPEUTIC EXERCISE

(76) Inventor: Joe S. Hakooz, 204 Tobacco Farm Dr., Apex, NC (US) 27502-4856

( * ) Notice: Subject to any disclaimer, the term of this patent is extended or adjusted under 35 U.S.C. 154(b) by 650 days.

This patent is subject to a terminal disclaimer.

(21) Appl. No.: 10/872,651

(22) Filed: Jun. 21, 2004

(65) Prior Publication Data

US 2005/0282691 A1 Dec. 22, 2005

(51) Int. Cl.
*A63B 22/00* (2006.01)
*A63B 71/00* (2006.01)

(52) U.S. Cl. ..... 482/51; 482/148

(58) Field of Classification Search ..... 482/51, 482/148

See application file for complete search history.

(56) References Cited

U.S. PATENT DOCUMENTS 3,511,500 A * 5/1970 Dunn ..... 482/113
4,448,411 A * 5/1984 Parker ..... 482/34
5,575,739 A * 11/1996 Piaget et al. ..... 482/51
5,833,575 A 11/1998 Holslag
6,042,521 A 3/2000 De Giorgis
6,348,028 B1 * 2/2002 Cragg ..... 482/148
6,402,669 B1 * 6/2002 Olstad ..... 482/123
6,666,802 B1 * 12/2003 Rasmussen ..... 482/148
6,709,368 B1 3/2004 Chue
7,255,666 B2 * 8/2007 Cardenas ..... 482/143
2002/0107114 A1 8/2002 Byrd, Jr.

OTHER PUBLICATIONS

Zen-Pro Foot and Leg Exerciser, offered for sale by Zen-Pro Ltd of Shillingford, United Kingdom.
Chattanooga Deluxe Exerciser, offered for sale by Promed Products of Atlanta, GA, USA.
Zen-Pro Foot and Leg Exerciser, offered for sale by Zen-Pro Ltd of Shillingford, United Kingdom.
Chattanooga Deluxe Exerciser, offered for sale by Promed Products of Atlanta, GA, USA.

* cited by examiner

*Primary Examiner*—Lori Amerson
(74) *Attorney, Agent, or Firm*—MacCord Mason PLLC

(57) ABSTRACT

An multimodal exercise device that is compact and designed for low impact therapeutic exercise allowing for multiple modes of motion for exercising or improving a user's circulation when the user places his or her feet or hands on the device's contact elements and moves them in at least one of the modes of motion. The device is preferentially used while the user is seated and can accommodate exercise in situations where exercise is not traditionally accomplished, such as at a desk, or while traveling in a plane, train, or automobile. The device includes a base, a stand, a connector, a beam, and two contact elements, configured in such a manner as to allow multiple modes of motion. Modes of motion include, but are not limited to, sliding, stepping, and cycling.

8 Claims, 4 Drawing Sheets

COMPACT MULTIMODE DEVICE AND METHOD FOR LOW IMPACT THERAPEUTIC EXERCISE

BACKGROUND OF THE INVENTION (1) Field of the Invention

The present invention relates generally to exercise devices and, more particularly, to compact low impact therapeutic exercise devices designed for increasing circulation in a user.

(2) Description of the Prior Art

Typically, a person does not or cannot exercise while they are sitting. It does not matter whether one is sitting at a desk, or traveling in a plane, train, or automobile; one does not traditionally exercise while sitting. Additionally, many people spend a majority of their time in a sitting or similar position, typically engaged in one of the aforementioned situations. Being able to exercise while sitting in a locale that one does not traditionally exercise at would be beneficial to a person.

The benefits that one could receive from being able to exercise while sitting in a traditionally non-exercising situation include, but are not limited to the following: 1) allowing low-impact office and/or therapy exercise; 2) improving blood circulation; and 3) enhancing weight control. These benefits would greatly help people who either need or want to exercise more and those who are in medical need of exercise through either a therapeutic or rehabilitation program that requires them to exercise during the day, regardless if they are sitting or not.

Furthermore, the mode of motion that a person moves his or her appendages to exercise is important. If one is sitting and performing a stepping motion with his or her feet, one is only exercising a certain subset of muscles. Likewise a different but limited subset of muscles is used for a cycling (circular or eliptical) or sliding (back and forth) motions. Additionally, being capable of alternating between different modes of exercising motion is important not only to exercise more and different muscles and muscle groups, but also to prevent an exercising person from becoming bored and uninterested in continuing to exercise.

Prior art exercise devices for use while sitting at a desk or similar locale commonly employ a stepping motion of a person's feet or at best one mode of motion for the feet, such as stepping, cycling, or sliding. However, the prior art does not appear to combine multiple modes of motion to permit one to exercise in their choice of motional mode.

An example of prior art that involves a stepping motion while sitting in a chair includes U.S. Pat. No. 6,709,368 issued to Chue, Mar. 23, 2004, for Foot Exercise Device. This patent describes a device0020 that has two steps (i.e. pedals or levers), as the exerciser is of the stair or step variety. First one foot presses down on one step, as the other step rises. Then, the other foot pushes down on the other step, and the stepping motion is reversed. Variable resistance in the form of mini-levers is provided.

Another example of prior art that involves a stepping motion while sitting in a chair includes U.S. Pat. No. 6,042,521 issued to De Giorgis, Mar. 28, 2000, for Exercising Means. This patent describes an exercise device to enable a person to exercise his or her feet while seated. More particularly, the exercising device enables a sitting person to simulate a walking action. The exercising device has a base, a pivot beam, and two footrests. Rear parts of the footrests can pivot with respect to the base by way of ball and socket fittings, and forward parts of the footrests can pivot with respect to the pivot beam by way of additional ball and socket fittings. The pivot beam can pivot with respect to the base by way of a further ball and socket fitting. When the exercising device is in use the person can place his or her feet on the footrests and tilt both the feet and footrests from side to side. The person can also cause forward parts of the footrests to move up and down alternately by way of the pivot beam by alternately pushing his or her feet down against the footrests.

An example of prior art that involves a cycling motion while sitting in a chair includes U.S. patent application Pub. No. 2002/0107114 issued to Byrd, Jr., Aug. 8, 2002, for Rotational Exercise System, Device and Method. This patent application publication describes an exercise device that includes a frame, a cranking assembly mounted to the frame and an extended user fixture. In one implementation of the device, a user sits in a chair and places his or her feet on pedals and moves the pedals in a cycling motion to turn a flywheel.

Another example of prior art that involves a cycling motion while sitting in a chair includes the Chattanooga Deluxe Exerciser, offered for sale by Promed Products of Atlanta, Ga., USA. This portable device requires a sitting user to place his or her feet on the footrests and then pedal in a cycling motion. The device has electronic controls and an LED display that shows you information such as speed, distance, total mileage, total time "ridden", and the amount of calories burned.

An example of prior art that involves a sliding motion while sitting in a chair includes U.S. Pat. No. 5,833,575 issued to Holslag, Nov. 10, 1998, for Portable Exercise Apparatus having Chair Mountable Support Base and Variable Resistance Exercise Arms. This patent describes a portable exercise apparatus that includes a support frame having a base mountable under a chair to hold the base in a stationary position with a user seated on the chair and an upright standard mounted upon the base, a shaft mounted to an upper end of the upright standard and having opposite ends extending from opposite sides thereof, a pair of arms disposed on opposite sides of the upright standard with each arm at one end mounted to one end of the shaft for rotatably mounting the arm to the upright standard, a pair of pedals each mounted to the other end of each of the arms for engagement by a user to create the force necessary to rotate the arms relative to the upright standard, and a resistance generating and adjusting mechanism disposed on the ends of the shaft at the opposite sides of the upright standard and engaged with the one ends of the arms and being operable to generate and selectively adjust a level of resistance to rotation of the pair of arms relative to the upright standard in response to rotation of the arms.

An example of prior art that attempts to combine multiple modes of motion while sitting in a chair includes the Zen-Pro Foot and Leg Exerciser, offered for sale by Zen-Pro Ltd of Shillingford, United Kingdom. This device requires the user to place his or her feet on the footrests, then one may rotate the feet on the rests and/or rock the device side-to-side. The device is not stable as the base is curved in order to accommodate the rocking motion. Furthermore, the device's foot holders are connected directly to the base, through a ball-in-socket connector.

The prior art does not appear to successfully combine at least the three previously discussed modes of exercising motion: sliding, cycling, and stepping. Thus, there remains a need for a compact low impact therapeutic exercise device designed for increasing circulation in a sitting user having multiple modes of motion.

SUMMARY OF THE INVENTION

The present invention is directed to an exercise device allowing for multiple modes of motion for exercising.

Preferably, the user sits down, places his or her feet or hands on contact elements, and then moves his or her feet or hands in a mode of motion, including, but not limited to, sliding, stepping, and cycling.

Thus, it is one aspect of the present invention to provide an exercise device with a base, a stand, a connector, a beam, and two contact elements; wherein the base is connected to the bottom of the stand, the stand is connected to the connector, the connector is connected to the beam, the contact elements are connected to the beam at the beam's ends, the connector provides at least a pivot motion, and the device is capable of providing multiple modes of motion for exercising when a user places each of his or her feet or hands on the contact elements for moving them in at least one of the multiple modes of motion for providing a multimodal exercise device for improving circulation of the user.

It is another aspect of the present invention to provide a method for exercising by placing the user's feet or hands on the contact elements and moving the user's feet or hands in at least one of the multiple modes of motion, wherein the multiple modes of motion are either sliding, stepping, and/or cycling.

These and other aspects of the present invention will become apparent to those skilled in the art after a reading of the following description of the preferred embodiment when considered with the drawings.

DETAILED DESCRIPTION OF THE PREFERRED EMBODIMENTS

Figure 1:
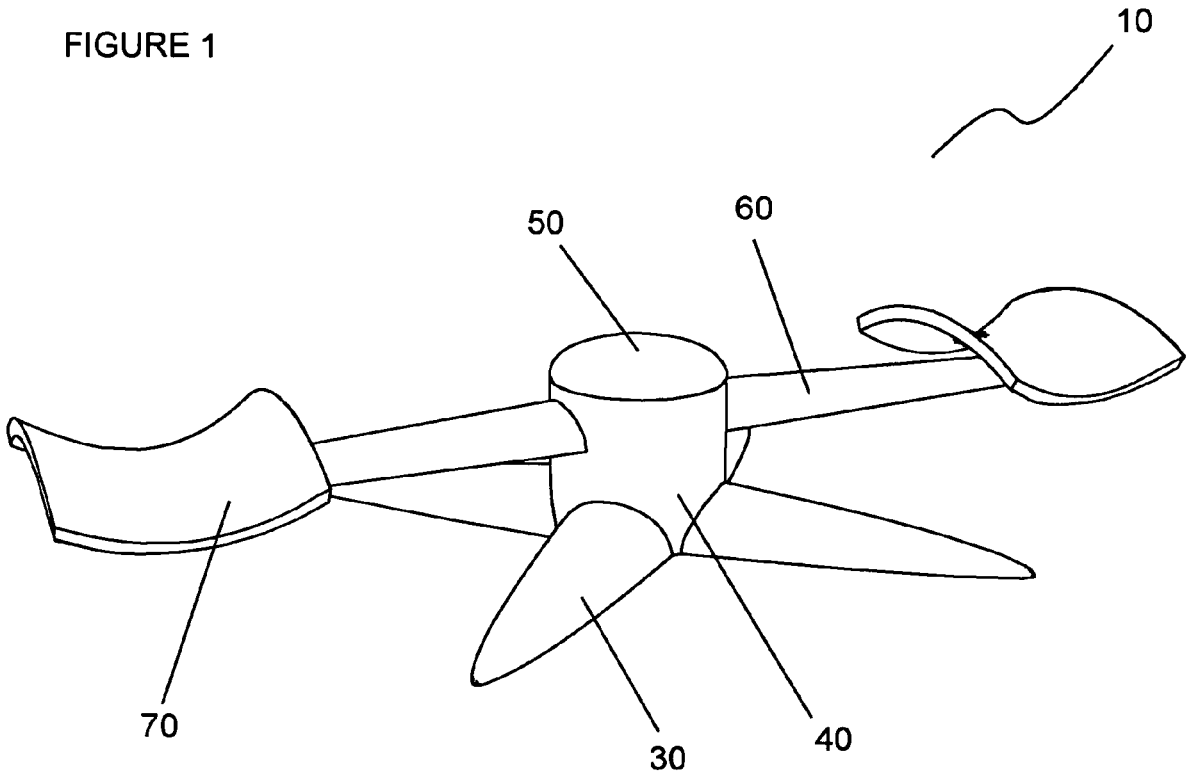
FIG. 1 is a perspective view of a device constructed according to the present invention.
Figure 2:
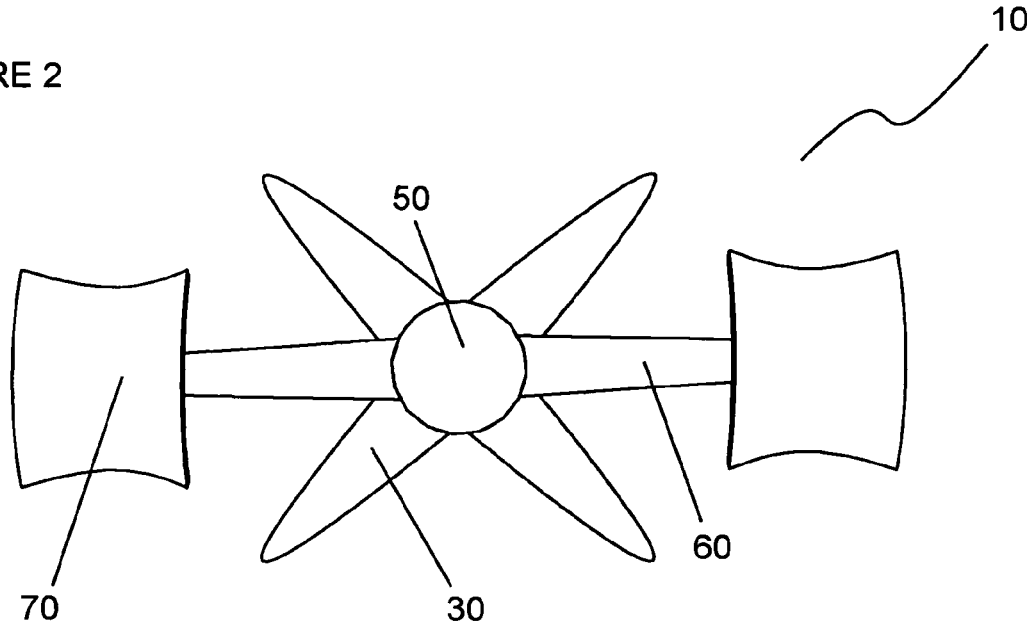
FIG. 2 is a top view of a device constructed according to the present invention.
Figure 3:
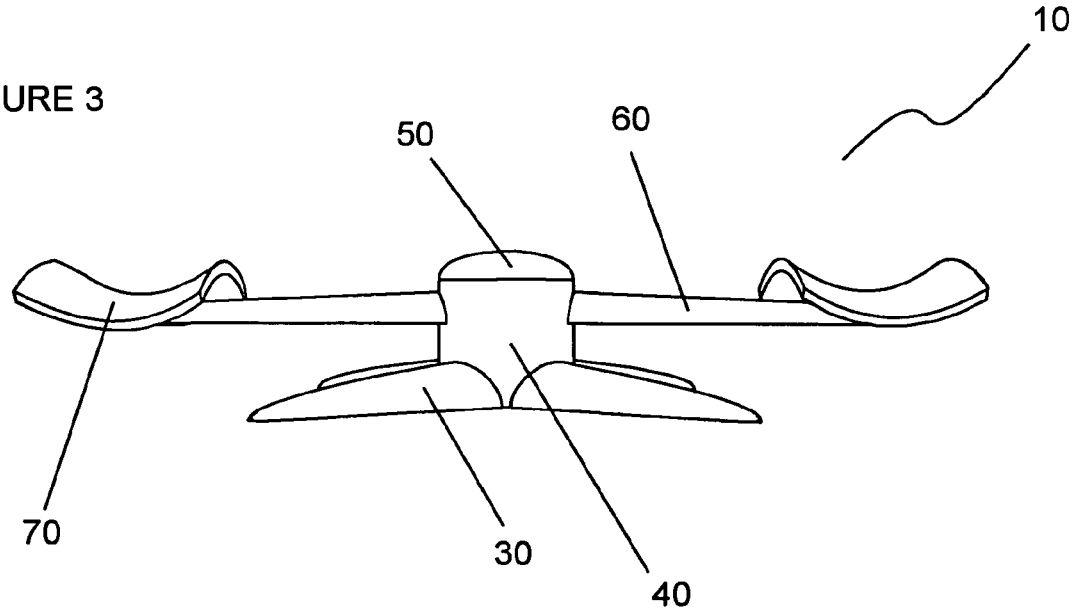
FIG. 3 is a front view of a device constructed according to the present invention.

In the following description, like reference characters designate like or corresponding parts throughout the several views. Also in the following description, it is to be understood that such terms as "forward," "rearward," "front," "back," "right," "left," "upwardly," "downwardly," and the like are words of convenience and are not to be construed as limiting terms.

Referring now to the drawings in general, the illustrations are for the purpose of describing a preferred embodiment of the invention and are not intended to limit the invention thereto.

As best seen in FIG. 1, the present invention, generally referred to as 10, includes a base 30, a stand 40, a connector 50, a beam 60, and two contact elements 70. The base is connected to the bottom of the stand, the stand is connected to the connector, the connector is connected to the beam, and the contact elements are connected to the beam at the beam's ends. The connector provides at least a pivot motion such that the beam may rotate in at least one direction.

The present invention provides a multimodal exercise device that is compact and designed for low impact therapeutic exercise being capable of providing multiple modes of motion for exercising when a user places his or her feet or hands on the device's contact elements 70, and moves them in at least one mode of motion. The device is preferentially used while the user is seated and can accommodate exercise in situations where exercise is not traditionally accomplished, such as at a desk, or while traveling in a plane, train, or automobile.

Figure 4:
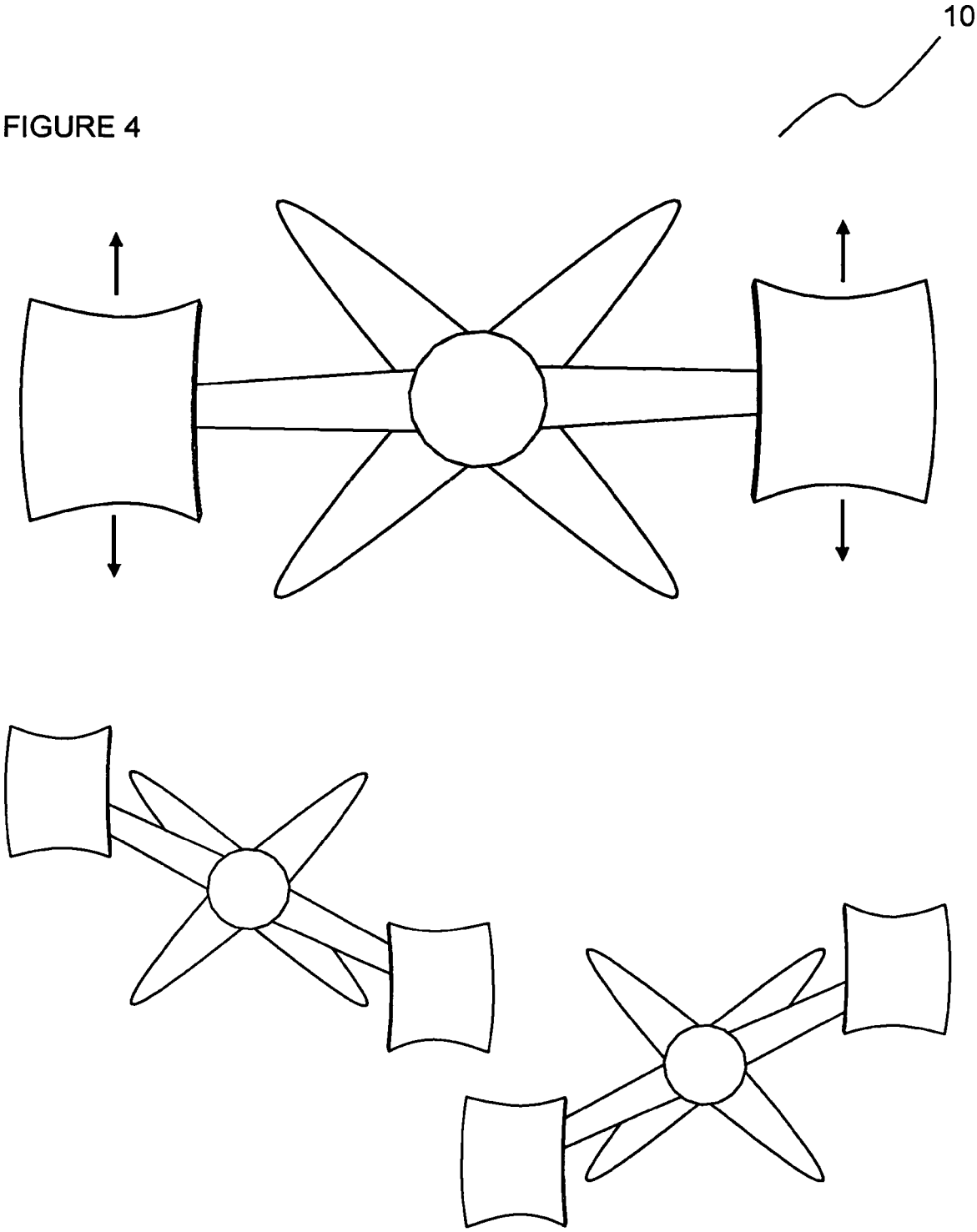
FIG. 4 is three top views of a device constructed according to the present invention demonstrating a sliding mode of motion.

Modes of motion include, but are not limited to, sliding, stepping, and cycling. As seen in FIG. 4, a sliding mode of motion is motion of at least a portion of the device wherein the contact elements move forwards and backwards, pivoting about the stand 40 at a central location of the beam 60. In the preferred embodiment of the invention, the sliding mode of motion is such that the contact elements move forwards and backwards relative to the user in a substantially horizontal plane.

Figure 5:
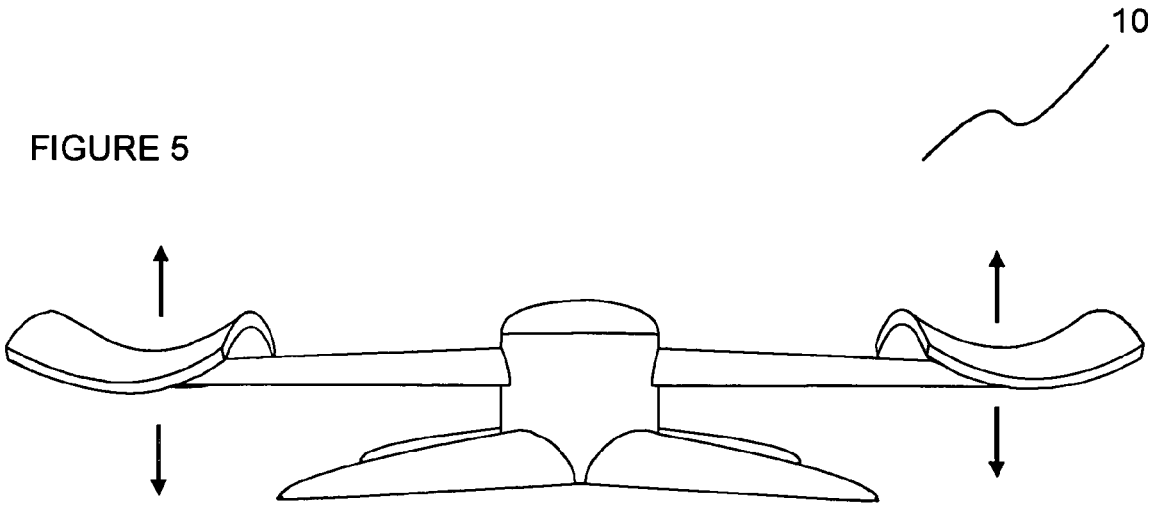
FIG. 5 is a front view of a device constructed according to the present invention demonstrating a stepping mode of motion.

As seen in FIG. 5, a stepping mode of motion is motion of at least a portion of the device wherein the contact elements 70 move up and down, pivoting about the stand 40 at a central location of the beam 60. In the preferred embodiment of the invention, the stepping mode of motion is such that the contact elements move up and down in a substantially vertical plane approximately parallel to the direction that the person using the device is facing.

Figure 6:
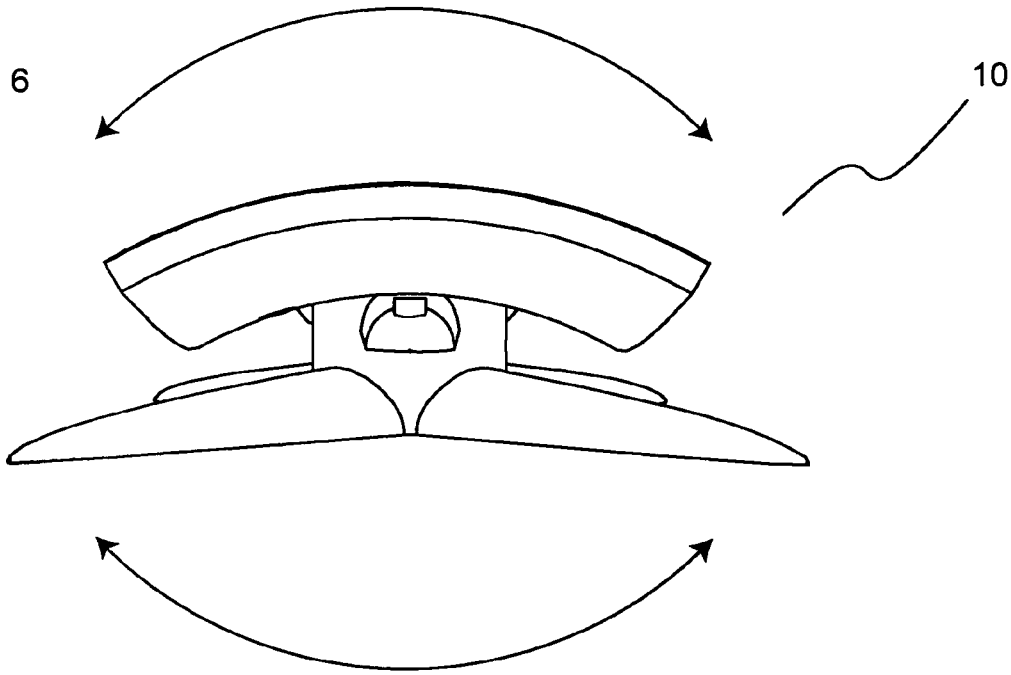
FIG. 6 is a side view of a device constructed according to the present invention demonstrating a cycling mode of motion.

As seen in FIG. 6, a cycling mode of motion is motion of at least a portion of the device wherein each contact element 70 moves in a substantially elliptical or circular pattern, pivoting about the stand 40 at a central location of the beam 60. In the preferred embodiment of the invention, the cycling mode of motion is such that each contact element moves in a substantially elliptical or circular pattern in a substantially vertical plane approximately parallel to the direction that the person using the device is facing.

The mode of motion may also be fixed such that the contact elements do not move relative to the base. This may be accomplished by locking the beam 60 or connector 50 such that neither rotates with respect to the base and/or stand. Fixing the mode of motion may provide for a user to rest his or her feet or hands on the contact elements without the contact elements moving.

The present invention should have at least two modes of motion. These modes may either be alternatively or selectively activatable and preferentially are selected from the sliding, stepping, and/or cycling modes of motion.

In a method for increasing circulation, the user places his or her feet or hands on the exercise device's contact elements and then moves his or her feet or hands in at least one of the multiple modes of motion. In the preferred method, the user is additionally sitting and the multiple modes of motion are either cycling, sliding, and/or stepping. These modes of motion should improve the users circulation and exercise various muscle groups providing, but not limited to, 1) low-impact office and/or therapy exercise; 2) improved blood circulation; and 3) enhanced weight control.

Certain modifications and improvements will occur to those skilled in the art upon a reading of the foregoing description. Also, additional modes of motion not mentioned above may include, but are not limited to, vibrating and rotating such that the user's joint or joints rotate in a circular motion about the joint or joints. Modes of motion are preferably alternatively available but may be combined selectively for improved user control and safety. All modifications and improvements have been deleted herein for the sake of conciseness and readability but are properly within the scope of the following claims.

What is claimed is:

1. An exercise device comprising a base, a stand extending upward from the base, a beam joined to the stand by a connector, and two contact elements mounted on the beam spaced from the stand, the connector having a pivot mounted to the stand enabling movement of the contact elements mounted on the beam in multiple modes of motion with respect to the stand, including at least two modes of motion selected from the group consisting of:

a. a sliding mode of motion in which the contact elements move forwards and backwards in a substantially horizontal plane, b. a stepping mode of motion in which the contact elements move up and down, and c. a cycling mode of motion in which the contact elements move in a substantially elliptical or circular pattern; thereby providing a multimodal exercise device for improving circulation of the user.

2. The exercise device according to claim 1, wherein the connector enables a cycling mode of motion such that each contact element moves in a substantially elliptical pattern.

3. The exercise device according to claim 1, wherein the connector enables a cycling mode of motion such that each contact element moves in a substantially circular pattern.

4. The exercise device according to claim 1, wherein the connector enables a fixed mode of motion such that the contact elements do not move relative to the base.

5. The exercise device according to claim 1, wherein the connector enables multiple modes of motion selected from the group consisting essentially of stepping, cycling, sliding, vibrating, rotating, and combinations thereof.

6. The exercise device according to claim 1, wherein the connector enables a vibrating mode of motion.

7. The exercise device according to claim 1, wherein one of the modes of motion is rotating whereby the user's feet or hands can rotate in a circular motion about the connector.

8. A method of increasing circulation in a person comprising the steps of:

a) placing the person's feet or hands on the exercise device according to claim 1 and b) moving the person's feet or hands in at least one of the multiple modes of motion.

* * * * *